US011479731B2

(12) United States Patent
Attia et al.

(10) Patent No.: US 11,479,731 B2
(45) Date of Patent: Oct. 25, 2022

(54) PROCESS FOR REMOVING SULFUR IN CRUDE OIL USING MICROWAVES

(71) Applicant: GREENOVEL INC., Saint-Constant (CA)

(72) Inventors: Mai Attia, Saint-Constant (CA); Sherif Farag, Saint-Constant (CA); Jamal Chaouki, Dorval (CA)

(73) Assignee: GreeNovel Inc.

( * ) Notice: Subject to any disclaimer, the term of this patent is extended or adjusted under 35 U.S.C. 154(b) by 0 days.

(21) Appl. No.: 17/250,863

(22) PCT Filed: Nov. 8, 2019

(86) PCT No.: PCT/CA2019/051601

§ 371 (c)(1),
(2) Date: Mar. 12, 2021

(87) PCT Pub. No.: WO2020/093174

PCT Pub. Date: May 14, 2020

(65) Prior Publication Data

US 2022/0056344 A1 Feb. 24, 2022

Related U.S. Application Data

(60) Provisional application No. 62/758,251, filed on Nov. 9, 2018.

(51) Int. Cl.
*C10G 29/20* (2006.01)
*C10G 32/02* (2006.01)

(52) U.S. Cl.
CPC ..... *C10G 29/20* (2013.01); *C10G 32/02* (2013.01); *C10G 2300/202* (2013.01); *C10G 2300/302* (2013.01); *C10G 2300/308* (2013.01)

(58) Field of Classification Search
CPC .. C10G 29/20; C10G 32/02; C10G 2300/202; C10G 2300/302; C10G 2300/308; C10G 21/27; C10G 31/08; C10G 29/26
See application file for complete search history.

(56) References Cited

U.S. PATENT DOCUMENTS 4,024,048 A * 5/1977 Shell ..... C10G 75/04 585/866
2016/0089661 A1* 3/2016 Nakao ..... B01J 21/16 502/214

OTHER PUBLICATIONS

Miadonye et al.. Desulfurization of Heavy Crude Oil by Microwave Irradiation; Computational Methods in Multiphase Flow V, 2009. 63: p. 455.

(Continued)

*Primary Examiner* — Randy Boyer
*Assistant Examiner* — Juan C Valencia
(74) *Attorney, Agent, or Firm* — Lavery, De Billy, LLP; Beatrice Ngatcha

(57) ABSTRACT

The present invention relates to a process for removing sulfur (S)-containing compounds in crude oil material. The process comprises causing the crude oil material to react with a removing agent, which comprises a phosphoric acid ester, and an aqueous phase in the presence of microwaves. The process of the invention is applied at ambient pressure and relatively low temperature compared to the conventional desulfurization processes. The process of the invention can be readily scaled up and integrated into an industrial facility.

20 Claims, 5 Drawing Sheets

(56) References Cited

OTHER PUBLICATIONS

C. O. Kappe, Controlled Microwave Heating in Modern Organic Synthesis; Angewandte Chemie International Edition, 2004. 43(46): p. 6250-6284.
X. Jiaxi, Microwave Irradiation and Selectivities in Organic Reactions; Progress in Chemistry-Beijing, 2007. 19(5): p. 700.
Dudley et al., On the Existence of and Mechanism for Microwave-Specific Reaction Rate Enhancement; Chem. Sci., 2015, 6, 2144.
Chen et al., Parameters Affecting the Microwave-Specific Acceleration of a Chemical Reaction; The Journal of organic chemistry, 2014. 79(16): p. 7425-7436.
Rosana et al., Microwave-Specific Acceleration of a Friedel-Crafts Reaction: Evidence for Selective Heating in Homogeneous Solution; The Journal of organic chemistry, 2014. 79(16): p. 7437-7450.

* cited by examiner

PROCESS FOR REMOVING SULFUR IN CRUDE OIL USING MICROWAVES

CROSS REFERENCE TO RELATED APPLICATIONS

This application claims benefit of U.S. Provisional Patent Application No. 62/758,251, filed on Nov. 9, 2018, the content of which is incorporated herein in its entirety by reference.

FIELD OF THE INVENTION

The present invention relates generally to processes for treating crude oil. More specifically, the invention relates to a process for removing sulfur in a crude oil material. The process according to the invention uses a sulfur removing agent which comprises a phosphoric acid ester. The process according to the invention uses electromagnetic waves to provide the heat energy needed to perform the sulfur removal reaction and other purposes.

BACKGROUND OF THE INVENTION

Petroleum crude oil is experiencing a considerable challenge due to the presence of sulfur and other impurities. Sulfur (S) has a catastrophic ecological impact, as $SO_x$ is emitted into the ecosystem, causing acid rain formation. Acid rain is mainly owing to the reaction of $SO_x$ with water forming sulfuric acid, which is carried away by air. The acid subsequently falls to earth in the form of rain, dust, snow, sleet, or hail.

Sulfur compounds not only have a negative impact on the environment but they also affect the contact surfaces during the refinery processes, generating serious corrosion problems for the instruments and pipelines. Furthermore, they reduce the lifetime of the catalyst during the common applied desulfurization processes. This issue raises the cost of refining because using a fresh catalyst to obtain new active sites with high performance is a must in most cases.

Sulfur exists in crude oil in different forms, such as mercaptans, sulfides, disulfides, and thiophenes outlined in FIG. 1 [1]. The detected percentage of sulfur in petroleum oil ranges from 0.1 wt. % to 15 wt. % and depends on several parameters, most importantly the origin of the extracted oil [2]. Removal of dibenzothiophene and its alkyl derivatives is a considerable challenge, as the compounds cannot be transferred into $H_2S$ due to the steric hindrance adsorption on the surface of the catalyst. The existence of sulfur in various forms, specifically the thiophinic form, is another challenge due to the difficlte removal of the element from its complex structure.

Serious attempts have been carried out to upgrade petroleum crudes by extracting both metals and sulfur from the oil. Various approaches have been published in the literature, such as solvent extraction, distillation, visbreaking and coking, applying a demetallization agent, and hydrodemetallization/hydrodesulfurization. Indeed, each technique faces several issues that can impede its objective in the industrial sector. For example, Hydrodemetallization and hydrodesulfurization techniques have been practiced in the industry. However, such processes are costly as extreme temperature and pressure conditions are required. In addition, an excessive volume of hydrogen is required for the reaction. The existence of the catalyst in this technique is a must, although it rapidly deactivates in a minimal period.

The bio-desulfurization processes are novel techniques for sulfur removal from crude oil by the action of certain microorganisms. The main disadvantages of the process are the degradation of the crude oil which destroys the main skeleton of the oil. Also, the long processing time of the technique is considered a big challenge.

The hydrotreatment process for sulfur removal (HDS) is the only process widely used in the industrial sector. This technique can remove around 90% of the sulfur content from the oil. Although the HDS process effectively removes a large portion of the sulfur, it suffers from several drawbacks. For example, they include the fast catalyst deactivation, high hydrogen consumption, an elevated temperature that ranges from 300 to 400° C. for light distillate and from 340 to 425° C. for heavy residual, and elevated pressure, which ranges from 30 to 130 atmosphere.

As can be seen, the removal of sulfur from crude oil has received considerable attention.

There is still a need for processes for lowering the sulfur contents of the crude oil. There is a need for such processes which are environmentally friendly, efficient, cost-effective and which can be readily scaled-up for industrial applications.

Applying microwave heating in the sulfur removal from crude oil can provide several advances, such as reaction acceleration, higher yield, and various selectivities. Microwave can also enforce some reactions that can not be achieved by superficial heating techniques [3-6].

It was announced further on in the research that employing microwave heating during the process demonstrates considerable superiority over the superficial heating technique, as it enhances the metals removal from the crude oil at a relatively significantly low bulk temperature compared to the superficial heating mechanism. Additionally, microwave heating reduces energy consumption due to the high heating selectivity [7-9], avoids heat transfer limitations, improves process flexibility and equipment portability, and is environmentally friendly, especially when clean electricity is used.

SUMMARY OF THE INVENTION

The inventors have designed and conducted a process for removing sulfur (S) and S-containing compounds from a crude oil material in presence of microwaves radiation. The process uses a removing agent which is a desulfurization agent (DSA) agent. The desulfurization agent according to the invention comprises a phosphoric acid ester.

In embodiments of the invention, the DSA is miscible to the crude oil. In embodiments of the invention, the DSA comprises a phosphoric acid ester.

In embodiments of the invention, the reacted DSA agent may be further treated such as to recover and or regenerate DSA which is re-used in the process. Also, any unreacted DSA may be recovered and re-used in the process.

The process of the invention can be readily scaled up and integrated in an industrial facility.

The invention thus provides the following in accordance with aspects thereof:

(1) A process for removing sulfur (S)-containing compounds in a crude oil material, comprising causing the crude oil material to react with a removing agent which comprises a phosphoric acid ester.

(2) A process for removing sulfur (S)-containing compounds in a crude oil material, comprising the steps of: (a) mixing the crude oil material with a removing agent, which comprises a phosphoric acid ester; and an aqueous phase, and subjecting the reaction mixture to stirring for a first period of time, at a temperature which is lower than the boiling point of the removing agent using microwaves; (b) adding a first mixture of solvents including water to the reaction mixture, and subjecting the aqueous reaction mixture to stirring for a second period of time, at a temperature which is less than about 95° C. using microwaves; (c) allowing the aqueous reaction mixture to stand for a third period of time, thereby obtaining an oil phase comprising a treated oil and one or more phases including an aqueous phase; and (d) subjecting the aqueous reaction mixture to separation thereby yielding the treated oil.

(3) A process according to (2), further comprising the steps of: (e) washing the treated oil using a second mixture of solvents including water; and (f) retrieving a washed treated oil, optionally steps (e) and (f) is repeated one time or more.

(4) A process according to (2), wherein the treated oil is further subjected to steps (b) to (d), one time or more.

(5) A process according to (2), wherein the treated oil is further subjected to steps (a) to (d), one time or more.

(6) A process according to (3), wherein a composition of the first mixture of solvents at step (b) and the second mixture of solvents at step (d) is the same or is different; optionally the first and second mixtures of solvent each independently comprises an organic solvent; optionally the organic solvent is an alcohol such as ethanol, or benzene, or hexane, or 4-methyl-2-pentanone.

(7) A process according to (3), wherein step (f) is conducted at ambient temperature.

(8) A process according to (2) or (3), wherein steps (a) to (f) each independently comprises use of a reflux system; optionally steps (d) and (f) each independently comprises decantation, centrifugation, filtration or a combination thereof.

(9) A process according to any one of (2) to (8), wherein a length of the first period of time at step (a) and the second period of time at step (b) is the same or is different.

(10) A process according to any one of (2) to (9), wherein the aqueous phase obtained at step (c) comprises reacted removing agent, and wherein the reacted removing agent is further subjected to a regeneration treatment to yield the removing agent; optionally the regenerated removing agent is re-used at step (a).

(11) A process according to (10), wherein the regeneration treatment of the reacted removing agent comprises causing the treated reacted removing agent to react with an acid; optionally the acid is HCl.

(12) A process according to any one of (2) to (11), wherein the one or more phases obtained at step (c) comprise at least one phase comprising unreacted removing agent in an organic solvent, and wherein the unreacted removing agent is re-used at step (a).

(13) A process according to any one of (2) to (12), wherein the aqueous phase obtained at any of the steps is re-used in the process.

(14) A process according to any one of (1) to (13), wherein an amount of the removing agent is: between about 1 vol. % to about 5 vol. % an amount of the crude oil, or between about 1 vol. % to about 4 vol. % an amount of the crude oil, or between about 1 vol. % to about 3 vol. % an amount of the crude oil, or between about 1 vol. % to about 2 vol. % an amount of the crude oil, or about 5 vol. % an amount of the crude oil; or about 1 vol. % an amount of the crude oil.

(15) A process according to any one of (1) to (14), wherein an amount of the removing agent is: between about 1 wt. % to about 5 wt. % an amount of the crude oil, or between about 1 wt. % to about 4 wt. % an amount of the crude oil, or between about 1 wt. % to about 3 wt. % an amount of the crude oil, or between about 1 wt. % to about 2 wt. % an amount of the crude oil, or about 5 wt. % an amount of the crude oil; or about 1 wt. % an amount of the crude oil.

(16) A process according to any one of (1) to (15), wherein sulfur in the crude oil is in a form selected from the group consisting of: thiol, sulfide, disulfide, thiolanes, thiophene, benzothiophene, dibenzothiophene and benzonaphtothiophene, and or other forms.

(17) A process according to any one of (1) to (16), wherein the removing agent is a phosphoric acid ester of general formula I below

I

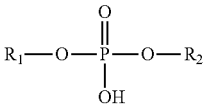

wherein $R_1$ and $R_2$ are each independently $C_1$ to $C_{20}$ a linear or branched, cyclic or non-cyclic, saturated or unsaturated alkyl group, optionally comprising a heteroatom which is O, S or N.

(18) A process according to (17), wherein $R_1$ and $R_2$ are each independently a $C_8$ to $C_{20}$ or a $C_8$ to $C_{18}$ or a $C_{16}$ a linear or branched, cyclic or non-cyclic, saturated or unsaturated alkyl group, optionally comprising a heteroatom which is O, S or N.

(19) A process according to any one of (1) to (18), wherein the sulfur removing agent comprises di-(2-ethylhexyl)phosphoric acid (DEHPA or HDEHP) outlined below

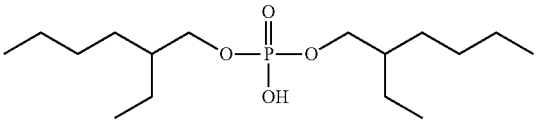

DEHPA or HDEHP

(20) A process according to (2), wherein the temperature at step (a) is between about 25° C. to about 80° C., or between about 25° C. to about 70° C., or between about 25° C. to about 60° C., or between about 25° C. to about 50° C., or between about 25° C. to about 40° C., or about 25, or about 80° C.

(21) A process according to any one of (2) to (20), wherein the temperature is provided using electromagnetic waves at the microwave frequency.

(22) A process according to any one of (2) to (21), wherein the temperature is provided using microwaves, or ultrasound, or induction heating, or electric field, or plasma or a combination thereof.

(23) A process according to any one of (1) to (22), wherein the sulfur removing agent is selected from the group consisting of: di-(2-ethylhexyl) phosphoric acid, bis(2-ethylhexyl) hydrophosphoric acid, di-(2-ethylhexyl) orthophosphoric acid, O,O-bis(2-ethylhexyl)phosphoric acid, orthophosphoric acid 2-ethylhexyl alcohol, phosphoric acid di(2-ethylhexyl) ester and Hostarex PA 216™.

(24) A process according to any one of (1) to (23), wherein the removing agent is miscible to the crude oil.

(25) A treated oil obtained by the process as defined in any one of (1) to (24).

(26) A treated oil obtained by the process as defined in any one of (1) to (25), wherein a content of S and S-containing compounds in the treated oil is about 90 to 100% or about 98% lower than in the crude oil.

(27) A treated oil obtained by the process as defined in any one of (1) to (25), wherein a content of S and S-containing compounds in the treated oil is about 95 to 100% or about 99% lower than in the crude oil.

(28) A treated oil obtained by the process as defined in any one of (1) to (25), wherein a content of S and S-containing compounds in the treated oil is about 98% lower than in the crude oil.

(29) A treated oil obtained by the process as defined in any one of (1) to (25), wherein a content of S and S-containing compounds in the treated oil is between about 60% to about 100% lower than in the crude oil, or between about 60% to about 90% lower than in the crude oil, or between about 60% to about 80% lower than in the crude oil, or between about 60% to about 70% lower than in the crude oil.

(30) A system for treating crude oil, which is adapted for conducting the process as defined in any one of (1) to (29).

(31) An oil treatment facility, comprising the system as defined in (30); optionally the facility is an industrial facility.

(32) A process according to (2), wherein a length of the period of time at step (a) is between about 1 min to about 5 min, or between about 1 min to about 4 min, or between about 1 min to about 3 min, or between about 1 min to about 2 min, or less than 1 min, or more 5 min.

(33) A process according to any one of (1) to (32) may be batch operated, semi-batch operated, continuous-flow operated, or combinations of thereof.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

Figure 1:
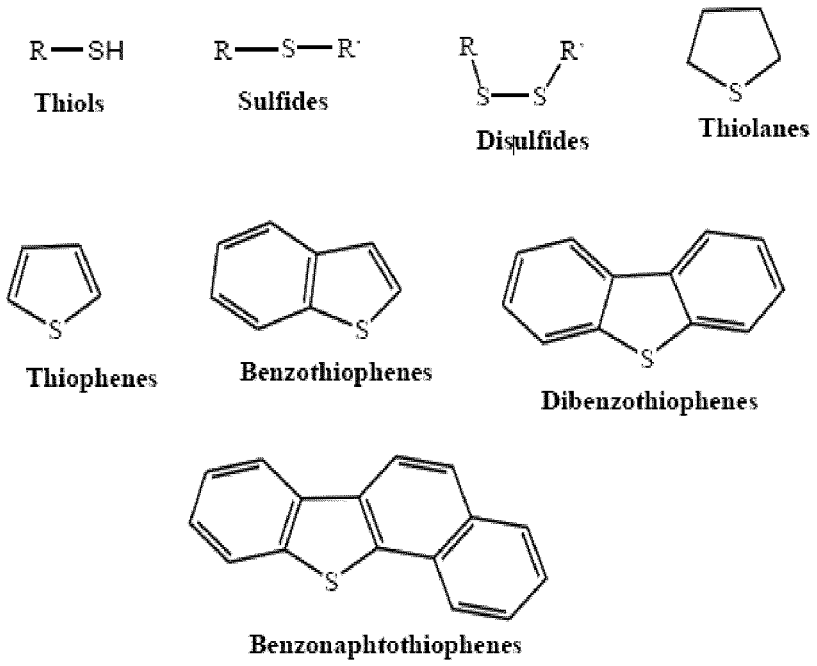
FIGURE 1 (PRIOR ART)
FIG. 1: Forms of sulfur in petroleum crude oil.

Before the present invention is further described, it is to be understood that the invention is not limited to the particular embodiments described below, as variations of these embodiments may be made and still fall within the scope of the appended claims. It is also to be understood that the terminology employed is for the purpose of describing particular embodiments; and is not intended to be limiting. Instead, the scope of the present invention will be established by the appended claims.

In order to provide a clear and consistent understanding of the terms used in the present specification, a number of definitions are provided below. Moreover, unless defined otherwise, all technical and scientific terms as used herein have the same meaning as commonly understood to one of ordinary skill in the art to which this disclosure pertains.

Use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

As used herein when referring to numerical values or percentages, the term "about" includes variations due to the methods used to determine the values or percentages, statistical variance and human error. Moreover, each numerical parameter in this application should at least be construed in light of the number of reported significant digits and by applying ordinary rounding techniques.

As used herein, the term "removing agent" or "desulfurization agent (DSA)" refers to a suitable agent that mixes with the crude oil and is adapted to removing sulfur (S)-containing compounds from the crude oil. Such agent may also be adapted to removing S in free form. Such agent comprises a phosphoric acid ester.

As used herein, the term "sulfur (S)-containing compounds" refers to any compound in the crude that comprises a sulfur atom. The term also refers to S in free form.

As used herein, the term "microwaves" refers to electromagnetic waves at any frequency between about 0.3 GHz and about 300 GHz.

As used herein, the term "desulfurization agent" refers to a suitable agent that mixes with the crude oil and is adapted to removing sulfur (S)-containing compounds. Such agent may also be adapted to removing S in free form. Such agent is also adapted to removing other impurities in the crude oil. Such agent comprises a phosphoric acid ester.

As used herein, the term "removing agent" refers to the desulfurization agent.

The inventors have designed and conducted a process for removing sulfur (S) and S-containing compounds from a crude oil material. The process uses a removing agent which is a desulfurization agent (DSA). The desulfurization agent according to the invention comprises a phosphoric acid ester.

The present invention is illustrated in further details in the Experiment Work section below. The section includes non-limiting examples.

Experimental Work Conducted

Materials: The desulfurization (DS) process according to the invention has been implemented on petroleum crudes obtained from two countries. Iran and Basra oils were obtained directly from the tanks of the TOTAL refinery station in France with a high concentration of S. Other chemical agents, such as the DSA and the solvents, were purchased from Sigma-Aldrich, Canada; di-(2-ethylhexyl)

phosphoric acid (DEHPA or HDEHP) outlined below was generally used as DSA in the experiments conducted.

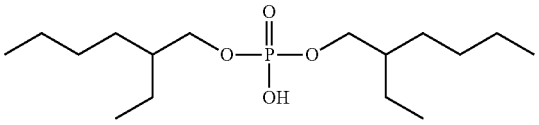

DEHPA or HDEHP

The concentration of sulfur in the oil samples was determined by the neutron activation analysis technique (NAA) using the SLOWPOKE reactor at Polytechnique Montreal, QC, Canada. The other required information archived directly from the supplier, Iran and Basra oils, are presented in Table 1 below.

TABLE 1

Characteristic of the processed oils.

| Property | Unit | Iran Oil | Basra Oil |
|---|---|---|---|
| Density (15° C.) | $kg/m^3$ | 881.2 | 886.8 |
| API | — | 28.99 | 27.98 |
| Viscosity (10° C.) | $mm^2/s$ | 18.4 | 23.8 |
| Viscosity (37.8° C.) | $mm^2/s$ | 10.6 | 9.32 |
| Viscosity (50° C.) | $mm^2/s$ | 8.67 | 6.79 |
| $S_{total}$ | mg/kg | 22795 | 26354 |
| CCR | % W | 6.88 | 7.845 |

Figure 2:
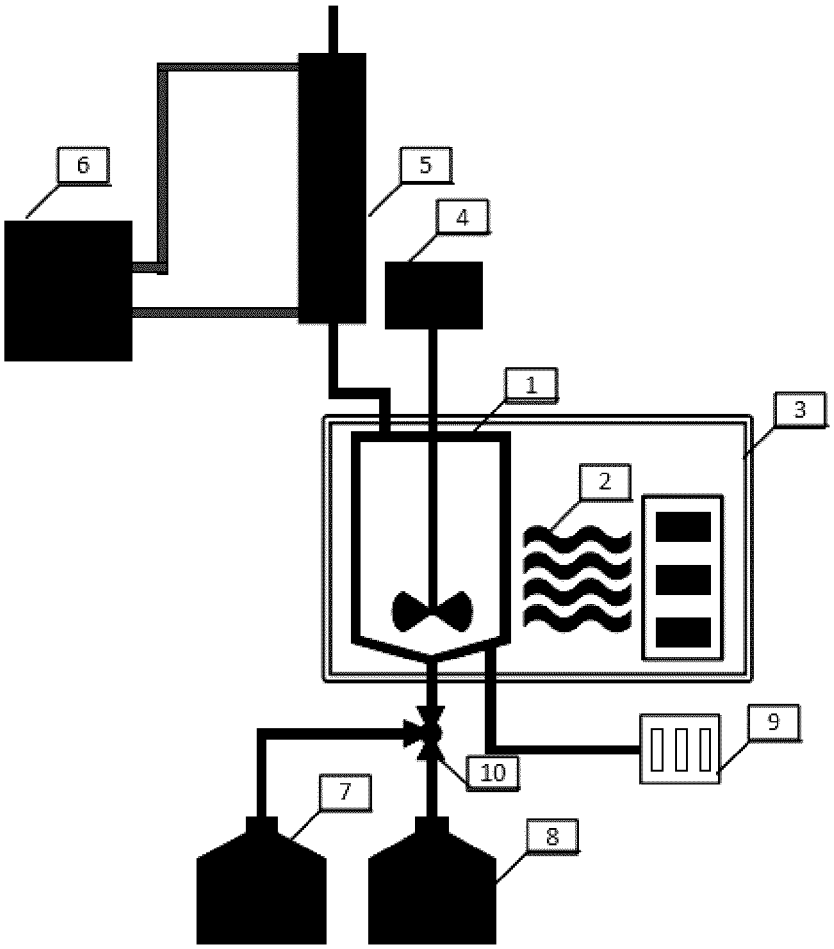
FIG. 2: Experimental setup of the process according to the invention.

Experimental setup: The experimental setup shown in FIG. 2 was employed to carry out the experimental work. The reference numerals in FIG. 2 are as follows: reactor (1), microwave generator (2), microwaves (3), agitator (4), heat reflux (5), water cooler (6), treated oil tank (7), washing liquids tank (8), thermometer (9) and three-ways valve (10).

The mixture of the crude oil and the reactants is poured into the batch reactor equipped with a stirring technique. The reactor is attached to a water-cooled condenser fitted onto the top. The condensation system, in other words, reflux, works at a temperature of about −5° C. and ambient pressure. The central role of the reflux is to condense the lower molecular weight compounds that might be vaporized during the reaction time due to increasing temperature. The reactor is heated using microwaves to a temperature lower than the boiling point of the DSA yet enough to perform the removal reaction. The temperature was controlled based on the direct measurement by using a thermometer does not interact with microwaves.

Figure 3:
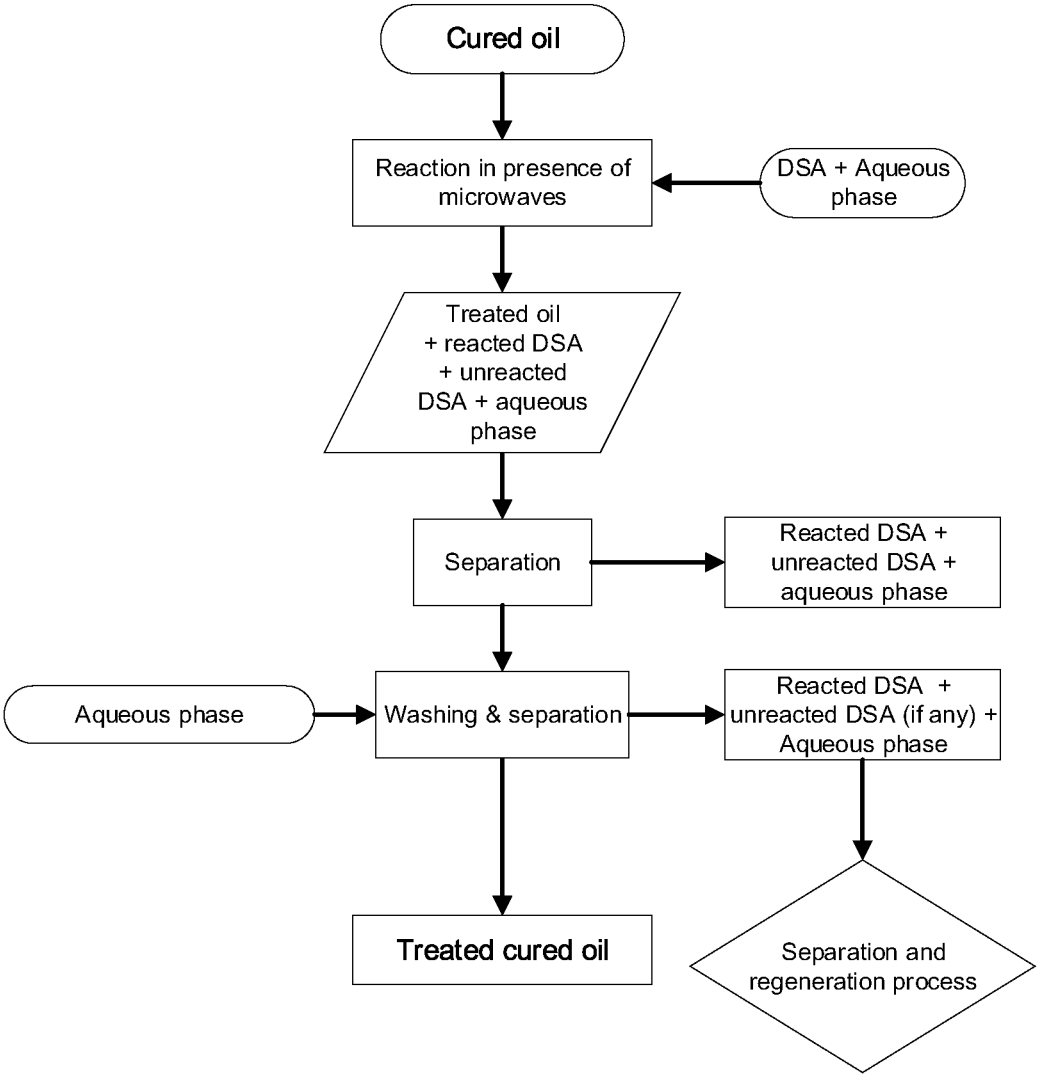
FIG. 3: Flowchart of the process according to the invention.
Figure 4:
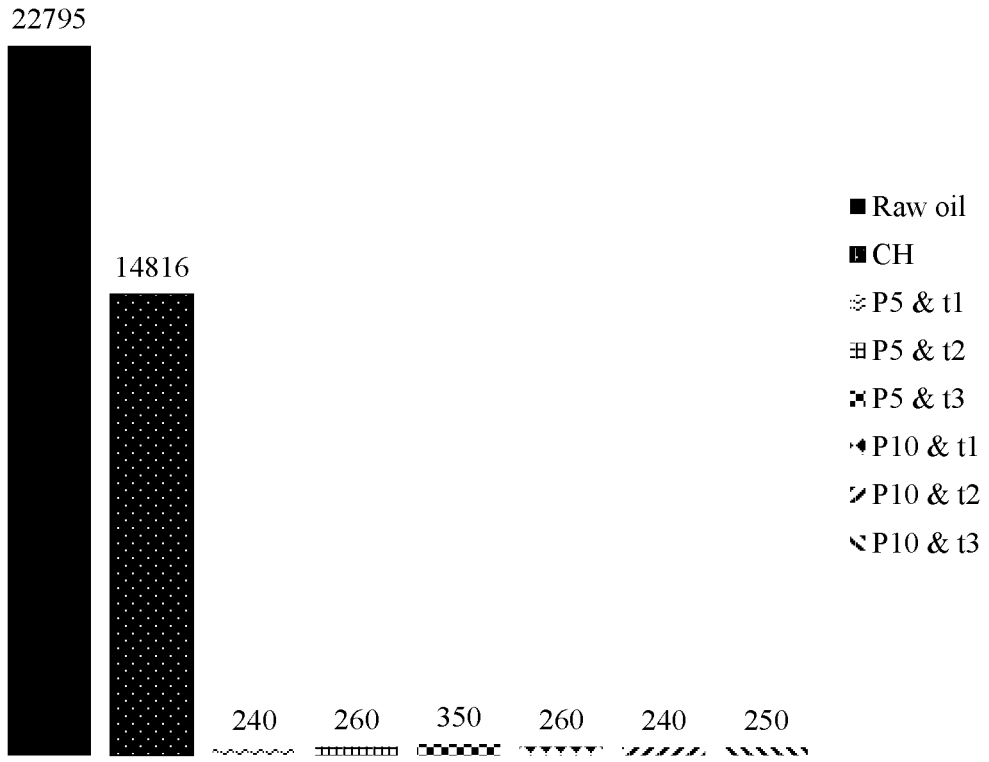
FIG. 4: Concentrations of S in raw and treated Iran oil using conventional and microwave heating (unit: ppm). P is the nominal power: P5≈500 W; P10≈1000 W; t1=1 min; t2=2 min; and t3=3 min.
Figure 5:
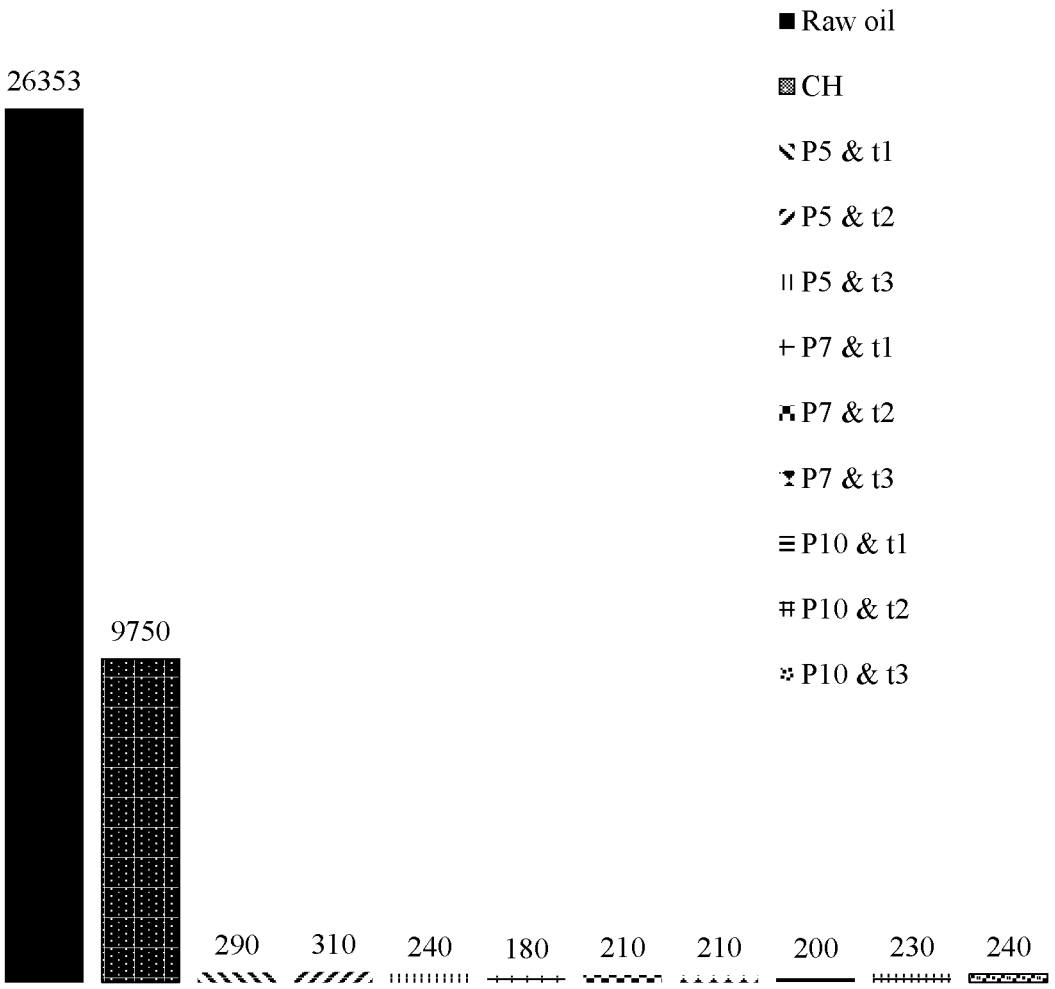
FIG. 5: Concentrations of S in raw and treated Basra oil using conventional and microwave heating (unit: ppm). P is the nominal power: P5≈500 W; P7≈700 W; P10≈1000 W; t1=1 min; t2=2 min; and t3=3 min.

Experiment procedures: A flowchart illustrating the process according to the invention is presented in FIG. 3, also showing the regeneration of various components of the process. The process comprises: treatment of the crude oil with the DSA in the presence of microwaves (reaction); separation of the treated oil from the reacted and/or unreacted DSA (in aqueous phase); and washing the treated oil. More details on each of the steps of the process are outlined herein below.

Treatment of crude oil with the DSA in the presence of microwaves (reaction): A weight/volume amount of the crude oil was mixed with the DSA. An amount of DSA between about 1 wt. % and 5 wt. % of the amount of the crude oil was generally used. The mixture of crude oil and DSA was poured into the reactor as outlined in FIG. 2. It is worth mentioning that the described process does not need an emulsification process, which is contrary to most of the existing chemical desulfurization techniques. The principal reason for this aspect is the good miscibility of the DSA according to the invention with crude oil. Electric stirring is applied during the reaction for mixing the reactants and for properly distributing the microwave-to-heat conversion inside the reactor. This enhances the replacement reaction taking place between the treated oil and the DSA. The mixture is heated for a few minutes at a temperature of about 80° C. at ambient pressure.

Separation: Efforts were made to carefully separate the treated oil from the reacted DSA (containing sulfur (S)-containing compounds) and any unreacted DSA. The challenge is due to the fact that all the components involved, namely, the treated oil, reacted DSA and any unreacted DSA, are all present in the same vessel. The separation process was performed using a mixture of solvents comprising organic solvents and water. In embodiments of the invention, an organic solvent such as an alcohol was used together with water. A first solvent was used mainly to dissolve any unreacted DSA and separate it from the treated oil. A second solvent, preferably in aqueous phase, was used to dilute the salts of DSA and other purposes. In embodiments of the invention ethanol and water were used. The mixture of the first and second solvents and the treated oil was then subjected to heating at a temperature of less than about 90° C. under stirring conditions and in the presence of microwaves for a few minutes. The separation is generally performed in a reflux system to avoid the evaporation of the solvent which would allow for the precipitation of the dissolved compounds back into the oil. After the separation time, a mixture of three phases could be observed in the reactor. The upper phase comprising the treated oil, the lower phase comprising both the reacted DSA dissolved in the aqueous phase and unreacted DSA dissolved in the used alcohol. Eventually, the two obtained phases were separated by decantation, or any other method, and, then, centrifugation. The organic solvent phase comprising the unreacted dissolved DSA was further separated from the aqueous phase to regenerate the unreacted DSA.

Washing the treated oil: After the separation, the collected oil phase was subjected to washing in order to ensure a complete removal of the reacted DSA and any unreacted DSA. More than one washing was performed, generally about three washings were performed. In embodiments of the invention, the first and second solvents used in the separation step were also used in the washings. Washing was performed at room temperature with stirring or shaking for few minutes. The mixture was then poured into a separation system where it was left to stand until complete detachment of the two phases. A centrifugal separation system was eventually used for the aqueous phase/oil phase separation; then the treated oil was sent for the analytical techniques.

Analytical techniques: Elemental analysis C, H, N, and S and Neutron activation analysis (NAA) were performed to validate the performance of the DSA according to the invention as well as to gain a better understanding of the process efficiency.

Neutron activation analysis: Neutron activation analysis is a nuclear technique used to determine the compactness of each element existing in vast numbers of chemical compounds. The analysis was performed in a slowpoke lab at Polytechnique Montreal, QC, Canada. In this technique, a neutron source is required for bombarding the sample with neutrons. Due to this bombardment, the element transfers to its isotopic form. According to the radioactive emission and decay data known for each element, the spectra of emission of gamma rays for all the elements can be easily studied.

An optimum method that can be used for sulfur quantification using the NAA technique is the k0-Neutron Activation analysis (k0-NAA). This method is a single-comparator standardized method used for high accuracy quantification of elements in any type of materials.

Quantification method: For the quantification of the sulfur in the crude and treated oil, the extraction efficiencies in the case of each oil were calculated. The extraction efficacy percentage was determined using the following equation:

$$\text{Extraction efficacy}(\%) = \frac{((C\ \text{crude} - C\ \text{treated})}{C\ \text{crude}} * 100,$$

where the $C_{crude}$ is the concentration of sulfur in the crude oil before the treatment process, $C_{treated}$ is the concentration of the sulfur in the treated oil after the treatment process.

Results and discussion: The DSA according to the invention has the ability to form an ionic liquid while it is present in oil at a lower temperature. The DSA is not miscible with water, but it forms compounds that are soluble in water at low and high temperatures. Thus, the unreacted part of the DSA can be recovered and recycled. The immiscibility of the agent with water may be attributed to the presence of long side chains in the agent ($R_1$ and $R_2$ in formula I are between about $C_8$ and $C_{10}$ chains), which reduces its polarity.

The reaction was performed using conventional heating (CH) and microwave heating (MWH) to discover the impact of the microwave heating. The removal efficiency of sulfur shows a high value, about 98% when applying microwaves, compared to about 30% using conventional heating. The considerable variation can be explained by the fact that it is essential to heat the entire oil until it reaches the local temperature of the reaction in the case of conventional heating. This, in turn, influences several aspects, most importantly the ionic liquid formed at a lower temperature.

The ionic liquid might be exposed to decomposition at elevated temperatures, leading to the re-separation of some sulfur compounds in the oil. On the other hand, using microwaves generates a temperature much lower than the decomposition temperature of the ionic liquid. The formed liquid is highly polar, i.e., high microwave receptor, providing a boost to the chemistry between the ionic liquid and the sulfur compounds and, consequently, an excellent opportunity for more sulfur compounds to connect with the DSA, which raises the removal efficiency of sulfur.

The DSA used for the desulfurization process is one of the most famous cations that can form ionic liquids with several anions. Both anion and cation species can interact forming an ionic liquid, or the cation can interact with a chloride anion from the oil medium forming another ionic liquid. The ionic liquid is formed by stirring both of the DSA with the crude oil [21].

When the ionic liquid is formed, it bonds with the thiophen compounds [24] in the oil through two different bonds: (1) through the H-bond between the S and the H from the agent, and (2) through the electrostatic force between the different charges of the high molecular weight part of both the agent and the thiophen compounds.

The process according to the invention allows for the removal sulfur in a crude material. The removing agent or DSA used in the process is a phosphoric acid ester such as di-(2-ethylhexyl)phosphoric acid (DEHPA or HDEHP) outlined above. As will be understood by a skilled person, the DSA may be any suitable phosphoric acid ester, for example of general formula I below. In embodiments of the invention, the DSA is miscible with the crude oil.

I

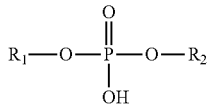

wherein $R_1$ and $R_2$ are each independently $C_1$ to $C_{20}$ a linear or branched, cyclic or non-cyclic, saturated or unsaturated alkyl group, optionally comprising a heteroatom which is O, S or N; optionally $R_1$ and $R_2$ are each independently a $C_8$ to $C_{20}$ or a $C_8$ to $C_{16}$ or a $C_{16}$ linear or branched, cyclic or non-cyclic, saturated or unsaturated alkyl group, optionally comprising a heteroatom which is O, S or N.

The process according to the invention comprises: at least one reaction step, at least one separation step, and at least one washing step. As will be understood by a skilled person these steps may involved other steps such as decantation, centrifugation, filtration.

The process according to the invention allows for the regeneration of the DSA from the reacted DSA. This is performed by causing the reacted DSA to react with an acid such as HCl. The regenerated DSA is re-used in the process. Also, any unreacted DSA is recovered and re-used in the process. Moreover, the aqueous phases stemming from the separations are recovered and re-used in the process.

A content of S and S-containing compounds in an oil treated by the process of the invention may be between about 90 to 100% or about 98% lower than in the crude oil. As will be understood by a skilled person, such treated oils are with the scope of the present invention.

The process according to the invention embodies a system and may be readily scaled up and integrated in an industrial facility. As will be understood by a skilled person, such system and facility are within the scope of the present invention.

The scope of the claims should not be limited by the preferred embodiments set forth in the examples; but should be given the broadest interpretation consistent with the description as a whole.

The present description refers to a number of documents, the content of which is herein incorporated by reference in their entirety.

REFERENCES

1. Hosseini, H. and A. Hamidi. Sulfur Removal of Crude Oil by Ultrasound-Assisted Oxidative Method. in International Conference on Biologi-cal, Civil and Environmental Engineering (BCEE-2014) March. 2014.
2. Miadonye, A., et al., Desulfurization of heavy crude oil by microwave irradiation. Computational Methods in Multiphase Flow V, 2009. 63: p. 455.
3. Hayes, B. L., Microwave synthesis: chemistry at the speed of light. 2002: Cem Corporation.
4. Kappe, C. O., Controlled microwave heating in modern organic synthesis. Angewandte Chemie International Edition, 2004. 43(46): p. 6250-6284.
5. Kappe, C. O., A. Stadler, and D. Dallinger, Microwaves in organic and medicinal chemistry. 2012: John Wiley & Sons.

6. Jiaxi, X., Microwave irradiation and selectivities in organic reactions. PROGRESS IN CHEMISTRY—BEIJING—, 2007. 19(5): p. 700.
7. Dudley, G. B., R. Richert, and A. Stiegman, On the existence of and mechanism for microwave-specific reaction rate enhancement. Chemical science, 2015. 6(4): p. 2144-2152.
8. Chen, P.-K., et al., Parameters affecting the microwave-specific acceleration of a chemical reaction. The Journal of organic chemistry, 2014. 79(16): p. 7425-7436.
9. Rosana, M. R., et al., Microwave-specific acceleration of a Friedel-Crafts reaction: Evidence for selective heating in homogeneous solution. The Journal of organic chemistry, 2014. 79(16): p. 7437-7450.

The invention claimed is:

1. A process for removing sulfur (S)-containing compounds in a crude oil material, comprising causing the crude oil material to react with a removing agent which comprises a phosphoric acid ester.

2. A process according to claim 1, wherein an amount of the removing agent is: between about 1 vol. % to about 5 vol. % an amount of the crude oil, optionally sulfur in the crude oil is in a form selected from the group consisting of: thiol, sulfide, disulfide, thiolanes, thiophene, benzothiophene, dibenzothiophene, and benzonaphtothiophene.

3. A process according to claim 1, wherein other impurities in the crude oil are also removed.

4. A process according to claim 1, wherein the removing agent is a phosphoric acid ester of general formula I below

I

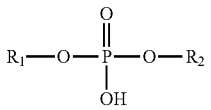

wherein $R_1$ and $R_2$ are each independently $C_1$ to $C_{20}$ a linear or branched, cyclic or non-cyclic, saturated or unsaturated alkyl group, optionally comprising a heteroatom which is O, S or N.

5. A process according to claim 4, wherein $R_1$ and $R_2$ are each independently a $C_8$ to $C_{20}$ linear or branched, cyclic or non-cyclic, saturated or unsaturated alkyl group, optionally comprising a heteroatom which is O, S, or N.

6. A process according to claim 1, wherein the sulfur removing agent comprises di-(2-ethylhexyl)phosphoric acid (DEHPA or HDEHP) outlined below

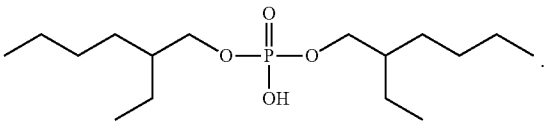

DEHPA or HDEHP

7. A process according to claim 1, wherein the temperature at step (a) is up to about 80° C.

8. A process according to claim 1, wherein the sulfur removing agent is selected from the group consisting of: di-(2-ethylhexyl) phosphoric acid, bis(2-ethylhexyl) hydrophosphoric acid, di-(2-ethylhexyl) orthophosphoric acid, O,O-bis(2-ethylhexyl)phosphoric acid, orthophosphoric acid 2-ethylhexyl alcohol, and phosphoric acid di(2-ethylhexyl) ester.

9. A process according to claim 1, wherein an amount of the removing agent is: about 2 vol. % an amount of the crude oil, or about 1 vol. % an amount of the crude oil, or about 5 wt. % an amount of the crude oil, optionally sulfur in the crude oil is in a form selected from the group consisting of: thiol, sulfide, disulfide, thiolanes, thiophene, benzothiophene, dibenzothiophene, and benzonaphtothiophene.

10. A process according to claim 4, wherein $R_1$ and $R_2$ are each independently a $C_8$ to $C_{16}$ linear or branched, cyclic or non-cyclic, saturated or unsaturated alkyl group, optionally comprising a heteroatom which is O, S, or N.

11. A process according to claim 4, wherein $R_1$ and $R_2$ are each independently a $C_{16}$ linear or branched, cyclic or non-cyclic, saturated or unsaturated alkyl group, optionally comprising a heteroatom which is O, S, or N.

12. A process for removing sulfur (S)-containing compounds in a crude oil material, comprising causing the crude oil material to react with a removing agent which comprises a phosphoric acid ester, wherein the removing agent is miscible to the crude oil and/or petroleum oil.

13. A process for removing sulfur (S)-containing compounds in a crude oil material, comprising the steps of:

(a) mixing the crude oil material with a removing agent, which comprises a phosphoric acid ester and an aqueous phase, and subjecting the reaction mixture to stirring and microwave heating for a first period of time, at a temperature which is lower than the boiling point of the removing agent;

(b) adding a first mixture of solvents including water to the reaction mixture, and subjecting the aqueous reaction mixture to stirring for a second period of time, at a temperature which is less than about 95° C. using microwaves for heating;

(c) allowing the aqueous reaction mixture to stand for a third period of time, thereby obtaining an oil phase comprising a treated oil and one or more phases including an aqueous phase; and (d) subjecting the aqueous reaction mixture to separation thereby yielding the treated oil.

14. A process according to claim 13, further comprising the steps of:

(e) washing the treated oil using a second mixture of solvents including water; and (f) retrieving a washed treated oil, optionally steps (e) and (f) is repeated one time or more, optionally the treated oil is further subjected to steps (b) to (d), one time or more, optionally the treated oil is further subjected to steps (a) to (d), one time or more, optionally step (f) is conducted at ambient temperature, optionally a length of the first period of time at step (a) and the second period of time at step (b) is the same or is different, optionally the aqueous phase obtained at any of the steps is re-used in the process.

15. A process according to claim 14, wherein a composition of the first mixture of solvents at step (b) and the second mixture of solvents at step (e) is the same or is different, optionally the first and second mixtures of solvent each independently comprises an organic solvent, optionally the organic solvent is an alcohol such as ethanol, or benzene, or hexane, or 4-methyl-2-pentanone.

16. A process according to claim 14, wherein steps (b) and (e) each independently comprises use of a reflux system, optionally steps (d) and (f) each independently comprises decantation, centrifugation, filtration, or a combination thereof.

17. A process according to claim 13, wherein the aqueous phase obtained at step (c) comprises reacted removing agent, and wherein the reacted removing agent is further subjected to a regeneration treatment to yield the removing agent, optionally the regenerated removing agent is re-used at step (a), optionally the reacted removing agent comprises sulfur (S)-containing compounds.

18. A process according to claim 17, wherein the regeneration treatment of the reacted removing agent comprises causing the treated reacted removing agent to react with an acid, optionally the acid is HCl.

19. A process according to claim 13, wherein the one or more phases obtained at step (c) comprise at least one phase comprising unreacted removing agent in an organic solvent, and wherein the unreacted removing agent is re-used at step (a).

20. A process according to claim 15, wherein the alcohol is ethanol.

* * * * *